US009155442B2

(12) United States Patent
Jerg et al.

(10) Patent No.: US 9,155,442 B2
(45) Date of Patent: Oct. 13, 2015

(54) DISHWASHER WITH AN IMPROVED PUMP-OFF SEQUENCE

(75) Inventors: Helmut Jerg, Giengen (DE); Andreas Reiter, Finningen (DE); Michael Georg Rosenbauer, Reimlingen (DE)

(73) Assignee: BSH Hausgeraete GmbH, Munich (DE)

( * ) Notice: Subject to any disclaimer, the term of this patent is extended or adjusted under 35 U.S.C. 154(b) by 956 days.

(21) Appl. No.: 13/193,650

(22) Filed: Jul. 29, 2011

(65) Prior Publication Data

US 2012/0042907 A1 Feb. 23, 2012

(30) Foreign Application Priority Data

Aug. 20, 2010 (DE) ..... 10 2010 039 612

(51) Int. Cl.
*A47L 15/46* (2006.01)
*A47L 15/00* (2006.01)

(52) U.S. Cl.
CPC ..... *A47L 15/0049* (2013.01); *A47L 15/0031* (2013.01)

(58) Field of Classification Search
CPC ..... A47L 15/0049
See application file for complete search history.

(56) References Cited

U.S. PATENT DOCUMENTS

2005/0005952 A1* 1/2005 Bashark ..... 134/18
2007/0251544 A1* 11/2007 Elick et al. ..... 134/10
2008/0115294 A1* 5/2008 Schaub et al. ..... 8/158

FOREIGN PATENT DOCUMENTS

EP 1942219 A1 * 7/2008 ..... D06F 33/02
EP 2009165 A1 * 12/2008 ..... D06F 33/02
WO WO2009003801 A3 * 1/2009 ..... A47L 15/46

* cited by examiner

*Primary Examiner* — Michael Barr
*Assistant Examiner* — Jason Riggleman
(74) *Attorney, Agent, or Firm* — James E. Howard; Andre Pallapies

(57) ABSTRACT

A dishwasher, in particular a household dishwasher, includes a control facility for performing a wash cycle to clean items to be washed based on a plurality of selectable wash programs. The control facility operates, in particular controls or regulates, a drain pump for pumping off wash fluid from the dishwasher. At least one of the wash programs includes an automatic execution of a pump-off sequence having at least three successively executed pump-off phases to define first, second and third pump-off phases, during each of which the drain pump is activated, with a break being provided between the first and second pump-off phases and a break being provided between the second and third pump-off phases, wherein the drain pump is deactivated during each of the breaks.

53 Claims, 4 Drawing Sheets

DISHWASHER WITH AN IMPROVED PUMP-OFF SEQUENCE

BACKGROUND OF THE INVENTION

The present invention relates to a dishwasher, in particular a household dishwasher, having a control facility for performing a wash cycle to clean items to be washed based on a selectable wash program and having a drain pump that can be set, in particular be controlled or regulated, by the control facility for pumping off wash fluid from the dishwasher.

Commercially available dishwashers are configured to clean dishes with wash fluid automatically. However despite sometimes complex operating methods it is not always possible to avoid undesirable spotting on the cleaned dishes.

BRIEF SUMMARY OF THE INVENTION

It is an object of the present invention to provide a dishwasher, in particular a household dishwasher, with which undesirable spotting on the cleaned dishes is reduced.

The object is achieved with a dishwasher of the type mentioned in the introduction in that at least one wash program can be selected, wherein at least one pump-off sequence is automatically performed, which comprises at least three pump-off phases, during which the drain pump is activated in each instance, with a break being provided between successive pump-off phases of the at least three pump-off phases, during which break the drain pump is deactivated.

The inventive dishwasher features a control facility for the automatic control of operating sequences of the dishwasher. To this end the control facility can be configured as what is known as a sequence controller, in particular an electronic sequence controller.

Stored in the control facility is at least one wash program for performing or controlling a wash process or wash cycle for washing items to be washed, in particular for washing dishes. A number of wash programs are advantageously provided here, one of which can be selected and started by the operator in each instance. This allows the sequence of a wash cycle to be matched in particular to the load quantity, the load type, the degree of soiling of the items to be washed and/or to the desired duration of the wash cycle.

The respectively stored wash programs can preferably be configured so that the wash cycle controlled in each instance by the wash program comprises a number of wash sub-cycles, in particular at least one prewash cycle for precleaning items to be washed, at least one cleaning cycle for the thorough cleaning of items being washed, at least one intermediate rinse cycle for removing dirty wash fluid from the items being washed, at least one final rinse to prevent spots on the items being washed and/or as preparation for a drying step or drying cycle, and/or at least one drying cycle for drying the items being washed, in the above time order. The prewash cycle, cleaning cycle, intermediate rinse cycle and final rinse cycle are referred to as water-conducting wash sub-cycles, since when they are performed, the items to be washed introduced into the wash chamber are treated with a wash fluid. During the drying cycle there is generally no provision for the use of wash fluid.

Treatment of the items to be washed with wash fluid here can take place in an essentially closed wash chamber, in particular of a wash container, of the dishwasher. An intake valve can be assigned to the wash chamber here to allow the wash chamber to be filled with wash fluid. A circulating pump for circulating a wash fluid can also be assigned to the wash chamber, to allow the wash fluid introduced into the wash chamber to be removed, for example from a wash fluid collector facility, and to be applied to the items to be washed by way of a spray system assigned to the wash chamber.

A wash fluid refers in particular here to a fluid which is provided to be applied to the items to be washed, to clean them and/or treat them in some other manner. The wash fluid can thus be provided for example also to heat the items to be washed, which is possible for example during a final rinse step, to prepare for a subsequent drying cycle, in which drying is at least partially based on the wash fluid adhering to the items being washed evaporating due to the heat stored in the items being washed.

The wash fluid entering the wash chamber by way of the intake valve is generally fresh water. In this process the wash fluid in the wash chamber can, depending on the operating phase of the dishwasher, also contain cleaning agents, cleaning aids, for example rinse aid and/or dirt detached from the items being washed. Instances are however also conceivable, in which water already containing the like can be introduced into the wash chamber as wash fluid by way of the intake valve.

Also assigned to the wash chamber is a drain pump to pump off wash fluid. The drain pump allows wash fluid that is no longer required, in particular heavily soiled fluid, present in the wash chamber to be removed, for example from the collector facility for wash fluid, and be discharged for example to a waste water disposal facility in the building.

During the performance of a wash cycle the drain pump is controlled and/or regulated by the control facility of the dishwasher as a function of the respectively selected wash program. Provision can be made in particular here for the wash fluid used in a water-conducting wash sub-cycle to be pumped off at the end of said water-conducting wash sub-cycle so that in the following wash sub-cycle the cleanest possible wash fluid or wash fluid that is less dirty can be introduced into the wash chamber and be used to clean the items being washed.

The drain pump is generally configured as a centrifugal pump, in particular as a radial pump, a mixed flow pump or an axial pump. A centrifugal pump here is a flow machine, in which the respective fluid is conveyed using centrifugal force by means of a rotating conveyor element. The design of the drain pump as a centrifugal pump ensures more reliably or in a different manner from a piston pump design that the function of the drain pump is ensured even if the wash fluid to be pumped off is extremely dirty.

When such a drain pump is activated, the quantity of wash fluid present in the dishwasher initially decreases in an essentially linear manner over time for the same rotation speed. However below a certain residual quantity of wash fluid such a quantity of air reaches the drain pump that the pressure for conveying wash fluid breaks down and therefore no more wash fluid is conveyed. This means that a residual quantity of wash fluid that cannot be pumped off during continuous operation of the drain pump remains in the dishwasher.

Surprisingly it has proven that the automatic performance of a pump-off sequence, which comprises at least three pump-off phases, during which the drain pump is respectively activated, with a break being provided between successive pump-off phases of the at least three pump-off phases, during which the drain pump is deactivated, can significantly reduce the residual quantity of wash fluid that cannot be pumped off during continuous operation of the drain pump and remains in the dishwasher, in other words partial quantities of this residual quantity can be pumped off very efficiently by the inventive "stop/start pumping" sequence.

The effect that produces the reduction of the residual quantity of wash fluid that cannot be pumped off is not conclusively explained. However it has proven that when the circulating pump is started up a pressure builds up to convey wash fluid, at least for a short time, even though the quantity of wash fluid is smaller than the residual quantity that cannot be pumped off during continuous operation of the drain pump. This effect, which is not relevant during the first of the pump-off phases due to the still large quantity of fluid there, occurs however for some unexplained reason not only during the second of the pump-off phases but also during the third of the pump-off phases and in some instances during further pump-off phases. This is surprising in so far as the quantity of wash fluid that can additionally be pumped off by starting up the drain pump would actually have to be pumped off after the second pump-off phase. By performing more than two pump-off phases the described effect can therefore be utilized in a multiple fashion, so that the residual quantity of wash fluid not pumped off can be reduced to a particularly significant degree.

By reducing the residual quantity of wash fluid that cannot be pumped off it is possible in particular to reduce the transfer of dirt and/or cleaning agents from the wash fluid used before the pump-off sequence to a wash fluid used after the pump-off sequence. This allows the dirt content and/or cleaning agent content of the last wash fluid used in a wash cycle to be reduced, thereby reducing spotting on the cleaned items. The cleaned items therefore take on a particular shine, particular if they are cutlery or glassware.

If a noticeable reduction in spotting on the cleaned items can be achieved by performing a second and third pump-off phase, it is also possible to perform a fourth pump-off phase, a fifth pump-off phase, etc., thereby further reducing spotting.

According to one advantageous development of the invention the first of the pump-off phases is provided to pump off at least 80%, preferably at least 90%, particularly preferably at least 95%, of the total quantity of wash fluid to be pumped off. This makes it possible to reduce the residual quantity of wash fluid remaining in the dishwasher effectively by means of the following pump-off phases.

According to one expedient development of the invention the first pump-off phase of the pump-off phases is provided to pump off a quantity of wash fluid that can be pumped off during continuous operation of the drain pump. This allows the residual quantity of wash fluid remaining in the dishwasher to be reduced particularly effectively by means of the following pump-off phases.

According to one expedient development of the invention a monitoring facility is provided to monitor a wash fluid stream conveyed by the drain pump, termination of the first pump-off phase of the pump-off phases being provided when the monitoring facility identifies that the wash fluid stream has dropped below a minimum value. When there is a drop below a minimum value for the quantity of wash fluid pumped off per unit of time, i.e. for the conveyed wash fluid stream, this indicates that the quantity of wash fluid that can be pumped off during continuous operation of the drain pump has essentially been pumped off. If termination of the first pump-off phase is initiated based on this criterion, it can be ensured that on the one hand the quantity of wash fluid that can anyway be pumped off in the first pump-off step has at least essentially been reached and on the other hand that an unnecessary duration of the first pump-off phase has been avoided.

According to one expedient development of the invention the drain pump features an electric motor, the monitoring unit being configured to monitor at least one electrical operating parameter of the electric motor. This is based on the knowledge that electrical operating parameters of electric motors of drain pumps change characteristically as a function of the conveyed wash fluid stream. In the case of a drain pump operated at a fixed voltage for example this applies to its current or power consumption. Thus for example at a given rotational speed the power consumption of a drain pump taking in air is generally much lower than the power consumption of a drain pump only taking in fluid. Such a monitoring unit here is of simple structure. This is the case in particular compared with monitoring facilities, which feature a special throughflow meter, e.g. a vane meter.

According to one expedient development of the invention termination of the first pump-off phase of the pump-off phases is provided when no drop below the minimum value for the wash fluid stream is detected by means of the monitoring facility after a predefined time period. This prevents the first pump-off phase being continued indefinitely if the monitoring facility malfunctions.

According to one advantageous development of the invention termination of at least one of the pump-off phases following the first pump-off phase and/or at least one of the breaks is time-controlled. This allows the pump-off sequence provided for to be realised in a simple manner, in particular without additional sensors.

According to one expedient development of the invention at least one of the breaks has a duration of at least 1 second, preferably at least 2 seconds, particularly preferably at least 4 seconds, and/or maximum 24 seconds, preferably maximum 12 seconds, particularly preferably maximum 7 seconds. The cited minimum values for the duration of the breaks are normally sufficient for the wash fluid in the drain pump that has become turbulent in the previous pump-off phase to become still during the respective break, allowing at least a temporary pressure build-up as the drain pump starts up. The cited maximum values also ensure that the entire pump-off sequence does not last longer than necessary.

According to one expedient development of the invention at least one of the pump-off phases following the first pump-off phase has a duration of at least 1 second, preferably at least 2 seconds, particularly preferably at least 4 seconds, and/or maximum 32 seconds, preferably maximum 16 seconds, particularly preferably maximum 8 seconds. With the cited minimum values for the duration of the pump-off phases following the first pump-off phase it is generally possible to achieve the quantity of wash fluid that can additionally be pumped as a maximum when the drain pump is started up in each of the following pump-off phases. The cited maximum values also ensure that the entire pump-off sequence does not last longer than necessary.

According to one advantageous development of the invention at least one wash program can be selected to perform a wash cycle, wherein the pump-off sequence is provided at the end of a wash sub-cycle provided as an intermediate rinse cycle. Precisely at the end of a wash sub-cycle provided as an intermediate rinse cycle a reduction of the quantity of wash fluid not pumped off results in a reduction in the transfer of cleaning agent and/or dirt to the last wash fluid of a wash cycle, which is generally the wash fluid of a wash sub-cycle configured as a final rinse cycle. This allows the shine effect on washed items to be enhanced particularly effectively.

According to one advantageous development of the invention at least one wash program for performing a wash cycle can be selected, wherein the pump-off sequence is provided at the end of a wash sub-cycle provided as a cleaning cycle. This generally prevents a transfer of cleaning agent and/or dirt to an intermediate rinse cycle, so that the wash fluid in this intermediate rinse cycle contains less cleaning agent and/or dirt. This allows a further transfer of cleaning agent and/or dirt to the last wash fluid of a wash cycle to be further minimised, thereby enhancing the shine effect on the washed items.

According to an advantageous development of the invention at least one wash program for performing a wash cycle can be selected, wherein a short pump-off sequence, which comprises fewer pump-off phases than the pump-off sequence, is provided at the end of a wash sub-cycle provided as a prewash cycle. At the end of a normal prewash cycle quite a large quantity of dirt generally still adheres to the items being washed. Since this is usually detached in the following cleaning cycle, a possible transfer of dirt due to wash fluid that is not pumped off from the prewash cycle to the cleaning cycle is of no consequence. It is therefore possible to deploy a short pump-off sequence without disadvantage at the end of a prewash cycle, thereby accelerating the performance of the wash cycle.

According to one advantageous development of the invention at least one wash program for performing a wash cycle can be selected, wherein a short pump-off sequence, which comprises fewer pump-off phases than the pump-off sequence, is provided at the end of a wash sub-cycle provided as a final rinse cycle. At the end of a final rinse cycle the wash fluid used is essentially free of cleaning agent and/or dirt. A transfer of cleaning agent and/or dirt to a later wash cycle is therefore very unlikely and not a problem. It is therefore possible to deploy a short pump-off sequence without disadvantage at the end of a final rinse cycle, thereby further accelerating the performance of the wash cycle.

According to an expedient development of the invention the drain pump comprises a brushless electric motor, preferably a brushless permanent magnet motor. The brushless electric motor can in particular be configured as a brushless direct current motor, also referred to as a BLDC motor, a brushless alternating current motor, also referred to as a BLAC motor, or a synchronous motor. The rotor of the motor here can feature at least one permanent magnet, while the stator features a number of electromagnets. The electromagnets here are commutated by way of an electronic control system. Compared with other possible motor designs this allows the motor to be started up in a defined manner from the stopped state, so that the quantity of wash fluid that can additionally be pumped off in the pump-off phases following the first pump-off can be maximised.

According to one advantageous development of the invention a circulating pump for applying wash fluid to items to be washed is deactivated during the entire duration of the pump-off sequence. This prevents wash fluid being distributed in the dishwasher by the circulating pump during the pump-off sequence, so that it cannot be pumped away by means of the drain pump.

The invention also relates to a method for operating a dishwasher, in particular a household dishwasher, having a control facility for controlling wash cycles based on a selectable wash program and having a drain pump that can be set, in particular be controlled or regulated, by a control facility for pumping off wash fluid from the dishwasher. A wash program is selected here, wherein at least one pump-off sequence is performed automatically, comprising at least three pump-off phases, for the duration of which the drain pump is activated in each instance, with a break being provided in each instance between successive pump-off phases of the at least three pump-off phases, for the duration of which break the drain pump is deactivated.

The inventive method allows spotting to be reduced on the cleaned dishes.

Other advantageous configurations and/or developments of the invention are set out in the subclaims.

The above advantageous configurations and/or developments of the invention and the advantageous developments of the invention set out in the dependent claims can be provided individually or in any combination with one another in the inventive dishwasher.

BRIEF DESCRIPTION OF THE DRAWINGS

The invention and its developments and their advantages are described in more detail below with reference to figures, in which.

DETAILED DESCRIPTION OF EXEMPLARY EMBODIMENTS OF THE PRESENT INVENTION

Figure 1:
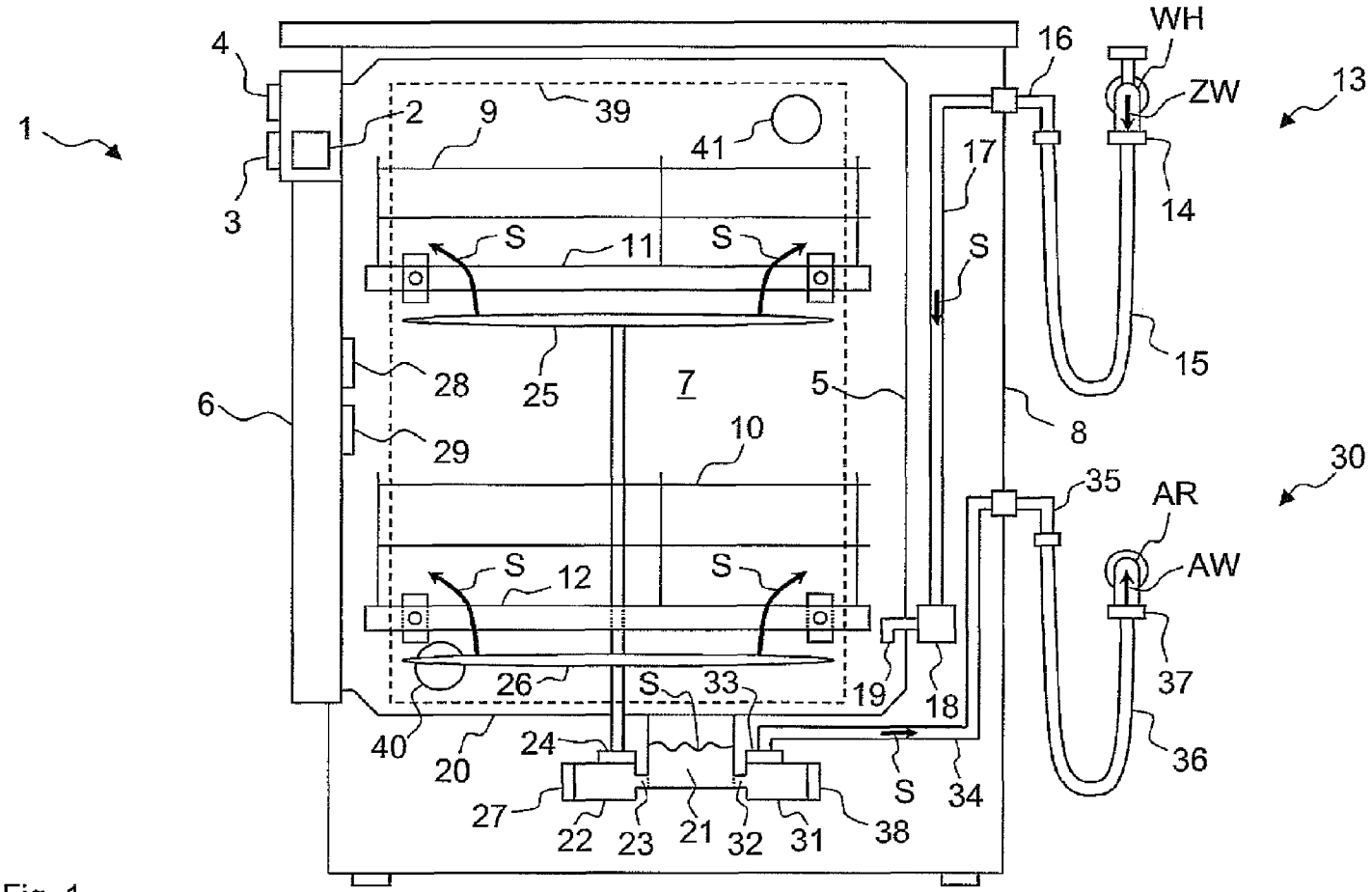
FIG. 1 shows a schematic side view of an advantageous exemplary embodiment of an inventive household dishwasher.

In the figures which follow corresponding parts are shown with the same reference characters. Only the components of a dishwasher that are necessary for an understanding of the invention are provided with reference characters and explained. It goes without saying that the inventive dishwasher can comprise further parts and modules.

FIG. 1 shows a schematic side view of an advantageous exemplary embodiment of an inventive household dishwasher 1. The dishwasher 1 features a control facility 2, in which at least one wash program for controlling a wash cycle for washing items to be washed, in particular dishes, is stored. A number of wash programs are expediently stored, so that by selecting a suitable wash program it is possible to match the sequence of a wash cycle controlled by the control facility 2 for example to the load quantity, the load type, the degree of soiling of the items to be washed and/or to the desired duration of the wash cycle.

An operating facility 3 is assigned to the control facility 2, allowing an operator of the dishwasher 1 to call up one of the wash programs and start it. Also assigned to the control facility 2 is an output facility 4, which allows messages to be output to the operator. The output facility 4 can comprise display lamps, light-emitting diodes, an alphanumeric display and/or a graphical display for outputting visual messages for example. In addition to or independently of the visual display the output facility 4 can also feature a buzzer, loudspeaker and/or the like for outputting acoustic messages.

The dishwasher 1 further comprises a wash container 5, which can be closed off by a door 6, producing a closed wash chamber 7 for washing items to be washed. The wash container 5 here can optionally be disposed in the interior of a housing 8 of the dishwasher 1. In the case of built-in dishwashers the housing 8 is not necessary and in some instances can be completely omitted at the top. FIG. 1 shows the door 6 in its closed position. The door 6 can be moved into its open position by pivoting about an axis perpendicular to the plane of the drawing, whereupon it is aligned essentially horizontally to allow the introduction or removal of items to be washed. In the exemplary embodiment shown in FIG. 1 the operating facility 3 is disposed in a user-friendly manner on an upper segment of the door 6. The output facility 4 is likewise disposed on the upper segment of the door 6, so that visual messages are clearly visible and/or acoustic messages can easily be heard. The control facility 2 is also positioned there so that the necessary signal connections can be kept short between the operating facility 3, the output facility 4 and the control facility 2. In principle however it is also possible to dispose the operating facility 3, the output facility 4 and/or the control facility 2 in different places. According to an alternative variant the control facility in particular can optionally also be accommodated in a base module below the wash container. The control facility 2 could also be configured in a decentralised manner, meaning that it comprises spatially separated components, which are connected by way of communication means in such a manner that they can interact.

To position items to be washed or dishes the dishwasher 1 has an upper rack 9 and a lower rack 10. The upper rack 9 here is disposed on guide rails 11, which are each fastened to opposing side walls of the wash container 5 extending depthways in said wash container. When the door 6 is open, the rack 9 can be moved out of the wash container 5 by means of the guide rails 11, to facilitate the loading and unloading of the upper rack 9. The lower rack 10 is disposed on guide rails 12 in a similar manner.

The wash program(s) stored in the control facility 2 can in each instance provide a number of wash sub-cycles, for example in this time order at least one prewash cycle, at least one cleaning cycle, at least one intermediate rinse cycle, at least one final rinse cycle and/or at least one drying cycle. The prewash cycle, cleaning cycle, intermediate rinse cycle and final rinse cycle here are referred to as water-conducting wash sub-cycles as when they are performed, the items to be washed positioned in the wash chamber 7 are treated with a wash fluid S. During the drying cycle there is generally no provision for treating the items being washed with wash fluid S.

In the present exemplary embodiment fresh water or intake water ZW is used as the wash fluid S for treating the items to be washed, this being able to be taken from an external water supply facility WH, in particular a drinking water supply network, and be introduced into the wash chamber 7 of the wash container 5. Typically at the start of each water-conducting wash sub-cycle a wash fluid S formed from fresh intake water ZW is introduced, which is then discharged at the end of the respective wash sub-cycle to an external waste water disposal facility AR as waste water AW. It is however also possible to store a wash fluid S of a wash sub-cycle for example in a storage container (not shown) and introduce it again into the wash chamber 7 in a subsequent wash sub-cycle.

The dishwasher 1 in FIG. 1 comprises a water intake facility 13, which is provided for connection to the external water supply facility WH. As in FIG. 1 the external water supply facility WH can be a tap WH of a water installation in the building, which supplies pressurised intake water ZW. The water intake facility 13 comprises a connector 14, which is provided for connection to the tap WH. The connection can be effected for example by way of a thread arrangement, a bayonet arrangement or the like. Downstream of the connector 14 is a connecting hose 15 which is preferably configured as flexible. The downstream end of the connecting hose 15 is connected to a connector 16 fixed to the housing.

Provided downstream of the connector 16 fixed to the housing is a supply line 17, which is connected to an input side of an intake valve 18 that can be switched by means of the control facility 2. An output side of the intake valve 18 is in turn connected to a fluid inlet 19 of the wash chamber 7. This allows intake water ZW to be conducted as wash fluid S into the interior of the wash chamber 7 of the dishwasher 1 by means of the water intake facility 13. The intake valve 18 here can be configured as a switchable solenoid valve, which only has an open position and a closed position. A water treatment system (not shown), for example a softening system, can be provided in the supply line 17.

Instead of or in addition to the intake valve 18 on the appliance an external intake valve, in particular what is known as an Aqua Stop valve can also be provided between the connector 14 and the tap WH, it being possible preferably to switch this, in particular block it or open it, by means of the control facility.

The wash fluid S introduced by way of a fluid inlet 19 into the wash chamber 7 enters a collector facility 21, preferably configured as a collector dish 21, configured on a base 20 of the wash container 5, due to its weight force. A circulating pump 22 is connected here in a fluid-conducting manner by its inlet 23 to the collector dish 21. Also in the exemplary embodiment an output side of the circulating pump 22 is connected by way of a preferably electrical heating facility 24 for heating wash fluid S to a spray facility 25, 26, allowing it to apply in some instances heated wash fluid S to the items to be washed introduced into the wash chamber 7. In the exemplary embodiment in FIG. 1 the spray facility 25, 26 comprises an upper rotatable spray arm 25 and a lower rotatable spray arm 26. However fixed spray elements or other spray facilities could alternatively or additionally be provided.

The wash fluid S exiting the spray facility 25, 26 when the circulating pump 22 is activated drops back into the collector dish 21 within the wash chamber 7 due to its own weight force. As the wash fluid S circulates in the wash chamber 7 the aim is to operate the circulating pump 22 in a true manner. The circulating pump 22 operates in a true manner when its inlet 23 is completely filled with wash fluid S in cross section so that only wash fluid S, or looking at it the other way, no air enters the interior of the circulating pump 22. By operating the circulating pump 22 in a true manner it is possible on the one hand to achieve a pump pressure that is adequate for an intended cleaning action and on the other hand to prevent annoying slurping or gurgling noises. In order now to determine whether or not the circulating pump 22 is operating in a true manner, a true operation monitoring unit 27 is assigned to it. This can be provided as a separate component or in some instances can also be part of the control facility 2. If non-true operation of the circulating pump 22 is identified by means of the true operation monitoring unit 27 during the circulation of wash fluid, additional wash fluid S can be introduced into the collector facility 21 by opening the intake valve 18, so that the fill level of wash fluid S in the collector facility 21 is increased and the circulating pump 22 starts to operate in a true manner as a result.

In the conventional manner the dishwasher 1 additionally features a dosing facility 28, which allows cleaning agents in powder form and/or liquid form to be added to the wash fluid S introduced into the wash chamber 7 to improve the cleaning action of a wash cycle. A further dosing facility 29 also allows the wash fluid S to be provided with in particular liquid rinse aid in order in particular to prevent spotting on the cleaned items and to enhance a drying action of a wash cycle.

The dishwasher 1 shown in FIG. 1 further features a drain facility 30 which serves to pump off wash fluid S that is no longer required as waste water AW out of the wash chamber 7 to the outside. The drain facility 30 comprises a drain pump 31, the inlet 32 of which is connected to the collector dish 21.

The output side of the drain pump 31 in contrast is connected by way of a check device 33 to a connecting line 34, the downstream end of which is connected to a connector 35 of the dishwasher 1 fixed to the housing. Fastened to an output of the connector 35 fastened to the housing is a waste water hose 36, which is configured as flexible. Disposed at the downstream end of the waste water hose 36 is a connector 37, which is provided to connect the drain facility 30 to a waste water disposal facility AR. The waste water disposal facility AR may be a waste water pipe AR of a water installation in the building. The connection between the connector 36 and the waste water pipe AR may be configured as a screw connection, a bayonet connection, a plug-in connection or the like.

This allows wash fluid S that is no longer required, in particular dirty wash fluid S, to be discharged from the collector facility 21 to the waste water disposal facility AR, with the check device 33, which can be configured for example as a check valve 33, preventing the wash fluid S already pumped out of the collector facility 21 and/or fluid originating from the waste water disposal facility AR getting into the collector facility 21 due to its own weight force and/or due to pressure fluctuations in the waste water disposal facility AR.

Assigned to the drain pump 31 is preferably a monitoring facility 38 for monitoring a quantity of wash fluid S conveyed per unit of time in each instance, in other words for monitoring the conveyed wash fluid stream. The monitoring facility 38 makes it possible to identify for example when, as wash fluid S is pumped out of the collector facility 21, the fill level of wash fluid S in the collector facility 21 drops so low that no more wash fluid S is conveyed.

In the exemplary embodiment here the drain pump 31 features an electric motor, the monitoring unit 38 in particular being configured to monitor at least one electrical operating parameter of the electric motor. This is based on the knowledge that electrical operating parameters of electric motors of drain pumps 31 change characteristically as a function of the conveyed wash fluid stream. In the case of a drain pump operated at a fixed voltage this applies to its current or power consumption. Thus for example at a given rotational speed the power consumption of a drain pump taking in air is generally much lower than the power consumption of a drain pump 31 only taking in fluid. Such a monitoring unit 38 here is of simple structure. This is the case in particular compared with monitoring facilities, which feature a special throughflow meter, e.g. a vane meter.

The electric motor of the drain pump 31 here can in particular be a brushless electric motor, preferably a brushless permanent magnet motor. The brushless electric motor can in particular be configured as a brushless direct current motor, also referred to as a BLDC motor, a brushless alternating current motor, also referred to as a BLAC motor, or a synchronous motor. The rotor of the motor here can feature at least one permanent magnet, while the stator features a number of electromagnets. The electromagnets here are commutated by way of an electronic control system. Compared with other possible motor designs this allows the motor to be started up in a defined manner from the stopped state, so that the quantity of wash fluid that can additionally be pumped off in the pump-off phases following the first pump-off can be maximised.

The dishwasher 1 in FIG. 1 further comprises a sorption drying apparatus 39 (only shown schematically), which allows air to be conducted in a circuit by way of a sorption column (not shown), to be introduced by way of an opening 40 into the wash chamber 7 and to be removed by way of a further opening 41 from the wash chamber 7, to be conducted again by way of the sorption column. In this process moisture present in the air is deposited on the sorption column, so that moisture is removed from the air. As the moisture is removed, the air heats up so that the air introduced into the wash chamber 7 is dry and warm. The sorption drying apparatus 39 is provided in particular to dry the items being washed in a drying sequence by means of the dried and heated air during a drying cycle of a wash cycle. In order to remove the moisture deposited on the sorption column again, the sorption column is provided with a heater (not shown), which is used to heat the sorption column during a regeneration sequence so that the moisture is released from the sorption column again. The regeneration sequence can in particular be performed during a cleaning cycle of a wash cycle, with the waste heat from the regeneration sequence then being able to be used to heat a wash fluid of the cleaning cycle, thereby reducing the energy requirement of the heating facility 24 assigned to the circulating pump 22.

Figure 2:
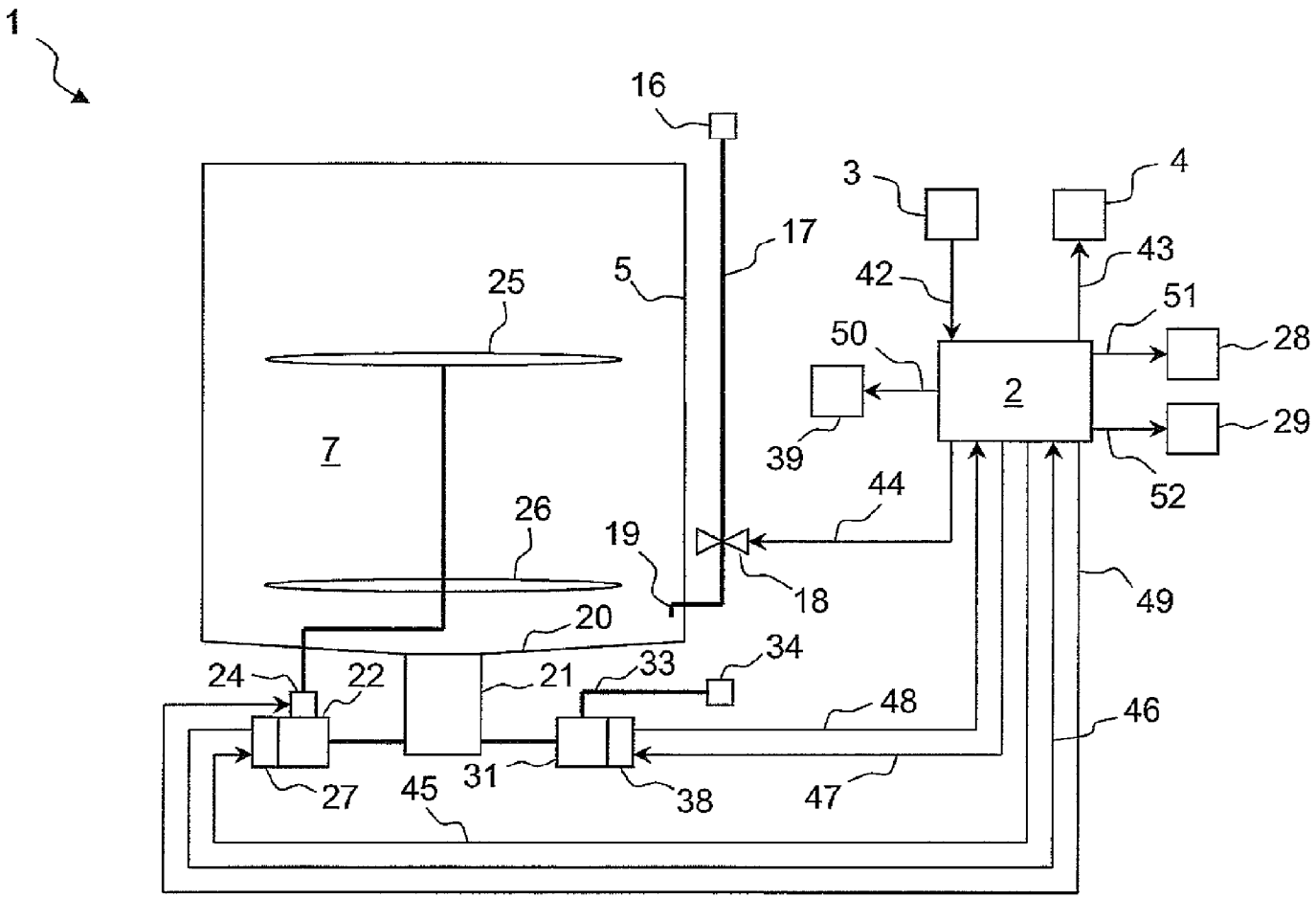
FIG. 2 shows a block diagram of the household dishwasher in FIG. 1.

FIG. 2 shows a block diagram of the household dishwasher 1 in FIG. 1, illustrating in particular its control and communication concept. In the exemplary embodiment a signal line 42 is provided, which connects the operating facility 3 to the control facility 2 such that operating commands from an operator can be transmitted from the operating facility 3 to the control facility 2. A signal line 43 is also provided, which connects the control facility 2 to the output facility 4, so that information provided by the control facility 2 can be transmitted to the output facility 4 and output there to the operator.

A control line 44 is further provided, which connects the control facility 2 to the switchable intake valve 18 such that the intake valve 18 can be closed or opened by the control facility 2. This allows the introduction of wash fluid S into the wash chamber 7 to be controlled by the control facility 2. A further control line 45 connects the control facility 2 to the circulating pump 22. This also allows the circulation of wash fluid S in the wash chamber 7 to be set, in particular to be controlled or regulated, by the control facility 2.

A signal line 46 is further provided, which connects the true operation monitoring unit 27 to the control facility 2. The signal line 46 allows information generated by the true operation monitoring unit 27 relating to the running properties of the circulating pump 22 to be transmitted to the control facility 2. The control facility 2 here is configured in such a manner that it can take such information from the true operation monitoring unit 27 into account when switching, in particular when controlling, optionally also controlling or regulating, the closing and/or opening times of the intake valve 18. The true operation monitoring unit 27 here can in particular also be configured as a functional component of the control facility 2.

A control line 47 is further provided, which connects the control facility 2 to the drain pump 31 so that the drain pump 31 can also be switched, in particular can be activated and deactivated, optionally also can be controlled or regulated, by the control facility 2. A further signal line 48 connects the monitoring facility 38 assigned to the drain pump 31 to the control facility 2, such that information generated by the monitoring facility 38 can be taken into account by the control facility 2 when performing wash cycles.

In the exemplary embodiment a further control line 49 connects the control facility 2 to the heating facility 24 assigned to the circulating pump 22 such that the heating facility 24 can be deployed as required by the control facility 2 during the course of a wash cycle.

The control facility 2 is also able by way of a further control line 50, which connects the control facility 2 and the sorption drying apparatus 39, to control and/or regulate the operation of the sorption drying apparatus 39.

The addition of cleaning agent to a wash fluid can also be influenced by the control facility 2 by way of a further control line 51, which connects the control facility 2 and the dosing facility 28.

Similarly the addition of cleaning agent to a wash fluid can also be influenced by the control facility 2 by way of a further control line 52, which connects the control facility 2 and the dosing facility 29.

Figure 3:
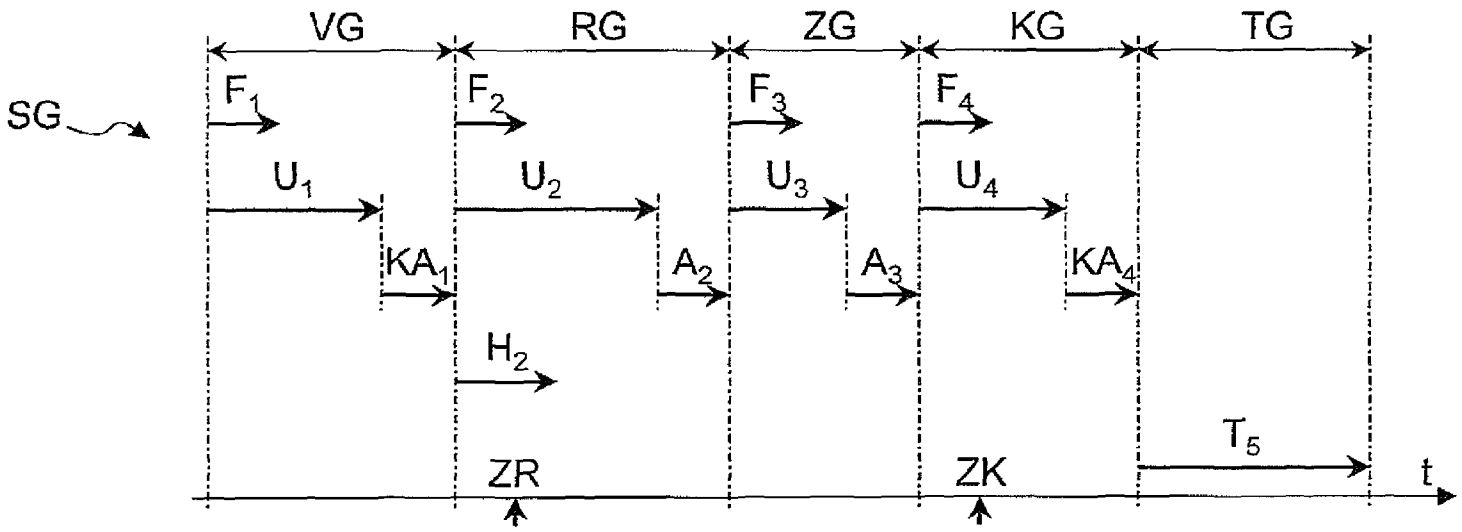
FIG. 3 shows a schematic diagram of a wash cycle over time for the household dishwasher in FIGS. 1, 2.

FIG. 3 shows an exemplary wash cycle SG of the inventive dishwasher 1, which brings about a particular shine effect on the cleaned items by reducing the transfer of dirt and/or cleaning agent to the last used wash fluid S. The wash cycle SG comprises a number of wash sub-cycles, specifically in the following time order a prewash cycle VG for precleaning items to be washed, a cleaning cycle RG for thoroughly cleaning items being washed, an intermediate rinse cycle ZG to remove dirty wash fluid S from the items being washed, a final rinse cycle KG to prevent spotting on the items being washed and a drying cycle TG to dry the items being washed. However in principle individual wash sub-cycles of those cited above, for example the prewash cycle VG, could be dispensed with. Similarly additional wash sub-cycles, for example a second intermediate rinse cycle, could be provided.

At the start of the prewash cycle VG a fill sequence $F_1$ is performed to fill the wash chamber 7 with wash fluid S. In the exemplary embodiment here the fill valve 18 is opened for a short time. Similarly at the start of the prewash cycle VG a circulation sequence $U_1$ is executed, wherein the items to be washed are subjected to circulated wash fluid S. To this end the circulating pump 31 is activated at least for a short time during the circulation sequence $U_1$. After the circulation sequence $U_1$ a short pump-off sequence $KA_1$ described in more detail below is performed, during which at least a significant proportion of the now dirty wash fluid S in the wash chamber 7 is discharged by means of the drain pump 31, for example to the waste water pipe AR. Performing the short pump-off sequence $KA_1$ at the end of the prewash cycle VG can accelerate the performance of the wash cycle, although an increased transfer of dirt to the following cleaning cycle RG is possible due to wash fluid that has not been pumped off. However this is not a major problem, as at the end of the prewash cycle VG quite a large amount of dirt still adheres to the items being washed, which is normally detached in the following cleaning cycle RG and contaminates the wash fluid S used there so that a possible transfer of dirt due to wash liquid that has not been pumped off from the prewash cycle to the cleaning cycle is not of consequence.

For the cleaning cycle RG now performed further wash fluid S is introduced into the wash chamber 7 by means of a further fill sequence $F_2$ and circulated in a further circulation sequence $U_2$. The cleaning action of the cleaning cycle is enhanced here in that in a heating phase $H_2$ the wash fluid S is heated for example by means of the heating facility 24 and/or by means of the waste heat from a regeneration phase of the sorption drying apparatus 39. To the same end the addition ZR of cleaning agent takes place in the cleaning cycle RG, for example by way of the dosing facility 28. This allows the dirt adhering to the items being washed to be almost completely detached in the cleaning cycle RG. To pump off the very dirty wash fluid S of the cleaning cycle RG, a pump-off sequence $A_2$, likewise described in more detail below, is performed, which is characterised in that a residual quantity of wash fluid S that cannot be pumped off is reduced compared with the short pump-off sequence $KA_1$. This reduces any transfer of dirt and/or cleaning agent to the intermediate rinse cycle ZG performed thereafter.

The intermediate rinse cycle ZG comprises a further fill sequence $F_3$ for filling the wash chamber 7 with wash fluid S and a further circulation sequence $U_3$, which essentially serves to rinse residues of the wash fluid S of the cleaning cycle RG from the items being washed. The problematic residues can be removed particularly effectively here, since the almost complete pumping off of the wash fluid S of the cleaning cycle R means that a particularly clean wash fluid is available in the intermediate rinse cycle ZG. The wash fluid S of the intermediate rinse cycle ZG also takes up little dirt and/or cleaning agent during the intermediate rinse cycle, so that the wash fluid S at the end of the intermediate rinse cycle ZG is much cleaner than it would have been if a short pump-off sequence had been performed at the end of the cleaning cycle RG. At the end of the intermediate rinse cycle ZG a pump-off sequence $A_3$ is performed, which is also characterised in that a residual quantity of wash fluid S that cannot be pumped off is reduced compared with the short pump-off sequence $KA_1$. This further reduces any transfer of dirt and/or cleaning agent to the final rinse cycle KG from the anyway already relatively clean wash fluid S of the intermediate rinse cycle Z.

In the final rinse cycle KG wash fluid S introduced by means of a further fill sequence $F_3$ is circulated in a circulation sequence $U_4$. Provision is made here for the addition ZK of rinse aid, for example by way of the dosing facility 29, to reduce the surface tension of the wash fluid S. This causes the wash fluid S to run off items being washed more effectively, which serves in the known manner to prevent spots on items being washed.

In particular it is advantageous that as a result of performing the specific pump-off sequences $A_2$ and $A_3$ the last wash fluid S of the wash cycle SG, in the exemplary embodiment the wash fluid of the final rinse cycle KG, contains much less dirt and/or cleaning agent, so that spotting on the cleaned items is further reduced.

The wash fluid of the final rinse cycle KG can be pumped off without any problem by means of a further short pump-off sequence $KA_4$, since its low dirt and/or cleaning agent content means that a significant transfer of dirt and/or cleaning agent to a later wash cycle SG is generally not possible.

In the final drying cycle TG the items being washed are dried during a drying sequence $T_5$ in the exemplary embodiment by means of dry/warm air of the sorption drying apparatus 39. It is however also possible for the items being washed to be dried without a sorption drying apparatus 39, in particular by what is known as inherent drying, wherein drying is based at least partially on the fact that the wash fluid S adhering to the items being washed evaporates due to the heat stored in the items being washed. To bring the items being washed to the required temperature during the final rinse cycle KG the wash fluid S used there could be heated by means of a heating phase not provided in the exemplary embodiment.

During the entire duration of the pump-off sequences $A_2$ and $A_3$ and the short pump-off sequences $KA_1$ and $KA_4$ the circulating pump 22 is deactivated in each instance. This prevents wash fluid S being distributed by the circulating pump 22 in the dishwasher 1 during the pump-off sequences $A_2$ and $A_3$ and the short pump-off sequences $KA_1$ and $KA_4$, so that it cannot be pumped off by means of the drain pump 31.

Figure 4:
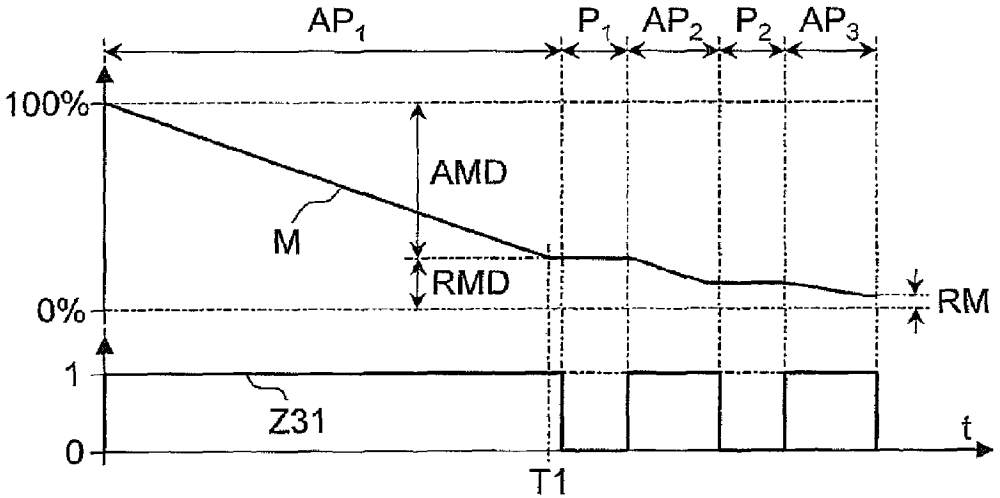
FIG. 4 shows a schematic diagram of a pump-off sequence of the dishwasher in FIGS. 1 and 2.

FIG. 4 shows a schematic diagram of a pump-off sequence A of the inventive dishwasher in FIGS. 1 and 2, corresponding to the pump-off sequences $A_2$ and $A_3$ shown in FIG. 3. The upper part of the diagram here shows the quantity M in % of the quantity of wash fluid S still present in the wash chamber 7 relative to the quantity present at the start of the pump-off sequence A over time t. This quantity M can also be referred to as a relative quantity M.

The lower part of the diagram shows the operating state Z31 of the drain pump 31. Here the operating state "1" means that the drain pump 31 is activated and the operating state "0" means that the drain pump 31 is deactivated.

The pump-off sequence A comprises three pump-off phases $AP_1$, $AP_2$ and $AP_3$, during which the drain pump 31 is activated continuously in each instance. Breaks $P_1$, and $P_2$ are also provided, during which the circulating pump 31 is continuously deactivated. The pump-off phase $AP_1$ is separated by a break $P_1$ from its adjacent pump-off phase $AP_2$ and this in turn is separated by a break $P_2$ from its adjacent pump-off phase $AP_3$.

The drain pump 31 can in particular be configured as an electric centrifugal pump, for example a radial pump, a mixed flow pump or an axial pump. The design of the drain pump 31 as a centrifugal pump ensures more reliably or in a different manner from a piston pump design that the function of the drain pump is ensured even if the wash fluid to be pumped off is extremely dirty.

When the drain pump 31, configured as a centrifugal pump, is activated at the start of the first pump-off phase $AP_1$, the relative quantity M of wash fluid S present in the dishwasher 1 initially decreases in an essentially linear manner over time for the same rotation speed of the drain pump 31. However below a certain residual quantity RMD of wash fluid S at time T1 such a quantity of air reaches the drain pump 31 that the pressure for conveying wash fluid S breaks down and therefore no more wash fluid S is conveyed. This state can be determined by means of the monitoring facility 38 for example based on monitoring an electrical parameter of the drain pump 31, it being possible for the first pump-off phase $AP_1$ to be terminated thereupon.

This means that a residual quantity RMD of wash fluid S that cannot be pumped off during continuous operation of the drain pump 31 remains in the dishwasher at the end of the first pump-off phase. On the other hand it ensures that during the first pump-off phase $AP_1$ the quantity AMD of wash fluid S that can be pumped off during continuous operation of the drain pump 31 is actually pumped off. This allows the residual quantity RM of wash fluid S remaining in the dishwasher 1 to be reduced particularly effectively by means of the following pump-off phases $AP_2$, $AP_3$.

Provision can optionally be made for termination of the first pump-off phase $AP_1$ to take place when the monitoring facility 38 detects that there is no drop below the minimum value for the wash fluid stream after a predefined time period. This prevents the first pump-off phase $AP_1$ being continued indefinitely if the monitoring facility 38 malfunctions.

After a break or dead time period P1, during which the drain pump 31 is deactivated, the relative quantity M of wash fluid decreases further during the following, second pump-off phase $AP_2$ with the drain pump 31 activated. The effect that reduces the relative quantity M of wash fluid S is not conclusively explained. It has however proven that when the circulating pump 31 is started up after the break $P_1$ a pressure builds up to convey wash fluid S, at least for a short time, even though the quantity of wash fluid S is smaller than the residual quantity RMD of wash fluid S that cannot be pumped off during continuous operation of the drain pump 31.

Surprisingly this effect also occurs after the second break $P_2$ during the third pump-off phase $AP_3$, so that the relative quantity M decreases further. This can significantly reduce a residual quantity RM of wash fluid S that cannot be pumped off with the pump-off sequence A and remains in the dishwasher 1 at the end of the pump-off sequence A. By performing at least three pump-off phases $AP_1$, $AP_2$ and $AP_3$ it is therefore possible to utilise the described effect in a multiple fashion so that the residual quantity RM of wash fluid not pumped off at the end of the pump-off sequence A can be reduced to a particularly significantly degree. To further reduce the residual quantity RM of wash fluid S that cannot be pumped off with the pump-off sequence A, it would therefore be possible optionally to provide further pump-off phases separated by breaks (not shown).

The breaks $P_1$ and $P_2$ here can have a duration of at least 1 second, preferably at least 2 seconds, particularly preferably at least 4 seconds, and/or maximum 24 seconds, preferably maximum 12 seconds, particularly preferably maximum 7 seconds. The cited minimum values for the duration of the breaks $P_1$ and $P_2$ are normally sufficient for the wash fluid S in the drain pump 31 that has become turbulent in the previous pump-off phase $AP_1$ or $AP_2$ to become still during the respective break $P_1$ or $P_2$, allowing at least a temporary pressure build-up as the drain pump starts up. The cited maximum values ensure that the entire pump-off sequence A does not last longer than necessary.

The pump-off phases $AP_2$ and $AP_3$ following the first pump-off phase $AP_1$ preferably have a duration of at least 1 second, preferably at least 2 seconds, particularly preferably at least 4 seconds, and/or maximum 32 seconds, preferably maximum 16 seconds, particularly preferably maximum 8 seconds. With the cited minimum values for the duration of the pump-off phases $AP_2$ and $AP_3$ following the first pump-off phase $AP_1$ it is generally possible to achieve the quantity of wash fluid S that can additionally be pumped as a maximum when the drain pump 31 is started up in each of the following pump-off phases $AP_2$ and $AP_3$. The cited maximum values also ensure that the entire pump-off sequence A does not last longer than necessary.

By reducing the residual quantity RM of wash fluid S that cannot be pumped off by means of the pump-off sequence A it is possible in particular to reduce any transfer of dirt and/or cleaning agents from the wash fluid S used before the pump-off sequence A to a wash fluid S used after the pump-off sequence A. This allows the dirt content and/or cleaning agent content in particular of the last wash fluid S used in a wash cycle SG to be reduced, thereby reducing spotting on the cleaned items. The cleaned items therefore take on a particular shine, particular if they are glassware.

Figure 5:
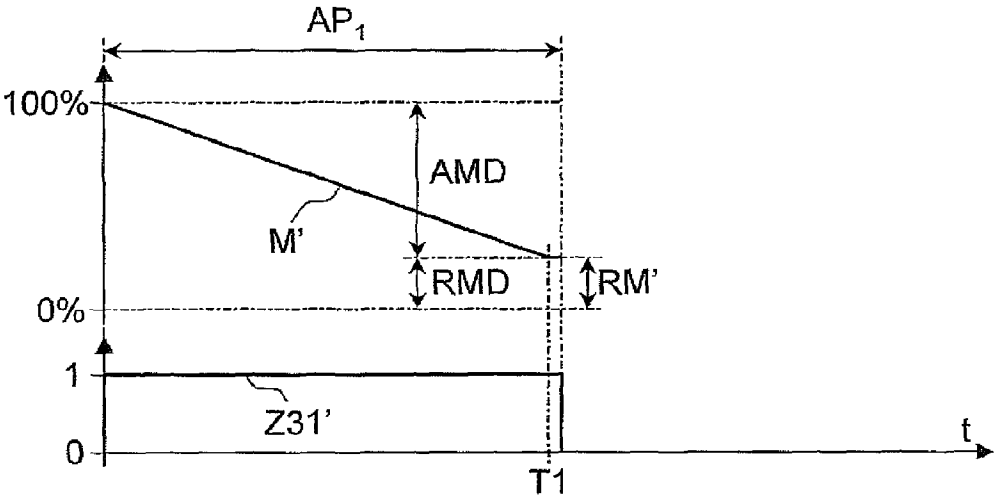
FIG. 5 shows a schematic diagram of a short pump-off sequence of the dishwasher in FIGS. 1 and 2.

FIG. 5 shows a schematic diagram of a short pump-off sequence KA of the inventive dishwasher 1 in FIGS. 1 and 2. The short pump-off sequence KA differs essentially from the pump-off sequence A, in that fewer pump-off phases, for example only one pump-off phase $AP_1$ is provided. As a result there is a changed relative quantity M' of wash fluid present in the wash chamber 7 over time, with the quantity RM' present at the end of the short pump-off sequence KA being greater than the quantity RM present at the end of the pump-off sequence A, which as already explained can be tolerated at the end of the prewash cycle VG and at the end of the final rinse cycle. However this has the advantage that the time required for the short pump-off sequence KA can be reduced considerably compared with the pump-off sequence A.

The invention has the effect that cleaned glasses and cutlery are much more spot-free. The effect is preferably achieved by combining a drying method with a sorption system, for example with a zeolite system, or a conventional drying method with the specific pump-off method set out above, which reduces transfers of dirt and or cleaning agent.

In particular to bring about the desired "shine drying" of the items being washed, preferably glasses, it may be expedient if at least a second intermediate rinse is additionally performed with an inventive pump-off sequence after the first intermediate rinse and the following final rinse.

What is claimed is:

1. A dishwasher, comprising:

a control facility programmed to control a wash cycle to clean items to be washed based on a plurality of selectable wash programs; and a drain pump operably connected to the control facility for pumping off wash fluid from the dishwasher, wherein the control facility is programmed to automatically execute, in at least one of the wash programs, a pump-off sequence configured to reduce a residual quantity of wash fluid remaining in the dishwasher at a completion of the pumping off the wash fluid from the dishwasher, the pump-off sequence having at least three successively executed pump-off phases during each of which the control facility is programmed to activate the drain pump, with a break being provided between each of the at least three successively executed pump-off phases, wherein the control facility is programmed to deactivate the drain pump during each of the breaks, wherein the pump-off sequence includes:

a first pump-off phase wherein the control facility is programmed to continuously operate the drain pump to remove substantially all of the wash fluid from the dishwasher;

a first break, following the first pump-off phase, wherein the control facility is programmed to continuously deactivate the drain pump;

a second pump-off phase, following the first break, wherein the control facility is programmed to continuously operate the drain pump to pump off a first partial quantity of the residual quantity of wash fluid remaining in the dishwasher at the completion of the first pump-off phase;

a second break, following the second pump-off phase, wherein the control facility is programmed to continuously deactivate the drain pump; and a third pump-off phase, following the second break, wherein the control facility is programmed to continuously operate the drain pump to pump off a second partial quantity of the residual quantity of wash fluid remaining in the dishwasher at the completion of the second pump-off phase, wherein the wash cycle comprises a plurality of sub-cycles and wherein the control facility is programmed to selectively execute the pump-off sequence only at ends of selective sub-cycles of the plurality of sub-cycles such that the pump-off sequence is not executed in all of the plurality of sub-cycles.

2. The dishwasher of claim 1, wherein the dishwasher is a household dishwasher.

3. The dishwasher of claim 1, wherein the control facility is programmed to control or regulate the drain pump.

4. The dishwasher of claim 1, wherein, in the first pump-off phase, the control facility is programmed to continuously operate the drain pump to remove substantially all of the wash fluid from the dishwasher that can be pumped off during continuous operation of the drain pump.

5. The dishwasher of claim 1, further comprising a monitoring facility programmed to determine when substantially all of the wash fluid is pumped from the dishwasher by monitoring a wash fluid stream conveyed by the drain pump, wherein the control facility is programmed to terminate the first pump-off phase when the monitoring facility identifies a drop below a minimum value for the wash fluid stream.

6. The dishwasher of claim 5, wherein the drain pump includes an electric motor, said monitoring facility being configured to monitor at least one electrical operating parameter of the electric motor.

7. The dishwasher of claim 5, wherein the control facility is programmed to terminate the first pump-off phase when the monitoring facility detects the absence of a drop below the minimum value for the wash fluid stream after elapse of a predefined time period during the continuous operation of the drain pump to remove substantially all of the wash fluid from the dishwasher.

8. The dishwasher of claim 1, wherein the control facility is programmed to terminate at least one of the second and third pump-off phases and/or at least one of the breaks in a time-controlled manner.

9. The dishwasher of claim 1, wherein at least one of the breaks has a duration of at least 1 second.

10. The dishwasher of claim 1, wherein at least one of the breaks has a duration of at least 2 seconds.

11. The dishwasher of claim 1, wherein at least one of the breaks has a duration of at least 4 seconds.

12. The dishwasher of claim 1, wherein at least one of the breaks has a duration of a maximum of 24 seconds.

13. The dishwasher of claim 1, wherein at least one of the breaks has a duration of a maximum of 12 seconds.

14. The dishwasher of claim 1, wherein at least one of the breaks has a duration of a maximum of 7 seconds.

15. The dishwasher of claim 1, wherein at least one of the second and third pump-off phases has a duration of at least 1 second.

16. The dishwasher of claim 1, wherein at least one of the second and third pump-off phases has a duration of at least 2 seconds.

17. The dishwasher of claim 1, wherein at least one of the second and third pump-off phases has a duration of at least 4 seconds.

18. The dishwasher of claim 1, wherein at least one of the second and third pump-off phases has a duration of a maximum of 32 seconds.

19. The dishwasher of claim 1, wherein at least one of the second and third pump-off phases has a duration of a maximum of 16 seconds.

20. The dishwasher of claim 1, wherein at least one of the second and third pump-off phases has a duration of a maximum of 8 seconds.

21. The dishwasher of claim 1, wherein the control facility is programmed to execute the pump-off sequence at an end of a sub-cycle of the wash cycle provided as an intermediate rinse cycle of the wash cycle.

22. The dishwasher of claim 1, wherein the control facility is programmed to execute the pump-off sequence at an end of a sub-cycle of the wash cycle provided as a cleaning cycle of the wash cycle.

23. The dishwasher of claim 1, wherein the drain pump comprises a brushless electric motor.

24. The dishwasher of claim 1, wherein the drain pump comprises a brushless permanent magnet motor.

25. The dishwasher of claim 1, further comprising a circulating pump for applying wash fluid to items to be washed, wherein the control facility is programmed to deactivate the circulating pump during an entire duration of the pump-off sequence.

26. The dishwasher of claim 1, wherein the plurality of sub-cycles includes a prewash cycle, a cleaning cycle, an intermediate rinse cycle, a final rinse cycle, and a drying cycle.

27. The dishwasher of claim 26, wherein the control facility is programmed to selectively execute the pump-off sequence only at one of:

an end of the cleaning cycle;

an end of the intermediate rinse cycle; and the end of the cleaning cycle and the end of the intermediate rinse cycle.

28. A dishwasher, comprising:

a control facility programmed to control a wash cycle to clean items to be washed based on a plurality of selectable wash programs; and a drain pump operably connected to the control facility for pumping off wash fluid from the dishwasher, wherein the control facility is programmed to automatically execute, in at least one of the wash programs, a pump-off sequence configured to reduce a residual quantity of wash fluid remaining in the dishwasher at a completion of the pumping off the wash fluid from the dishwasher, the pump-off sequence having at least three successively executed pump-off phases during each of which the control facility is programmed to activate the drain pump, with a break being provided between each of the at least three successively executed pump-off phases, wherein the control facility is programmed to deactivate the drain pump during each of the breaks, wherein the pump-off sequence includes:

a first pump-off phase wherein the control facility is programmed to continuously operate the drain pump to remove substantially all of the wash fluid from the dishwasher;

a first break, following the first pump-off phase, wherein the control facility is programmed to continuously deactivate the drain pump;

a second pump-off phase, following the first break, wherein the control facility is programmed to continuously operate the drain pump to pump off a first partial quantity of the residual quantity of wash fluid remaining in the dishwasher at the completion of the first pump-off phase;

a second break, following the second pump-off phase, wherein the control facility is programmed to continuously deactivate the drain pump; and a third pump-off phase, following the second break, wherein the control facility is programmed to continuously operate the drain pump to pump off a second partial quantity of the residual quantity of wash fluid remaining in the dishwasher at the completion of the second pump-off phase, wherein the control facility is programmed to execute a short pump-off sequence, which comprises fewer pump-off phases than the pump-off sequence, at the end of a sub-cycle of the wash cycle provided as a prewash cycle of the wash cycle.

29. A dishwasher, comprising:

a control facility programmed to control a wash cycle to clean items to be washed based on a plurality of selectable wash programs; and a drain pump operably connected to the control facility for pumping off wash fluid from the dishwasher, wherein the control facility is programmed to automatically execute, in at least one of the wash programs, a pump-off sequence configured to reduce a residual quantity of wash fluid remaining in the dishwasher at a completion of the pumping off the wash fluid from the dishwasher, the pump-off sequence having at least three successively executed pump-off phases during each of which the control facility is programmed to activate the drain pump, with a break being provided between each of the at least three successively executed pump-off phases, wherein the control facility is programmed to deactivate the drain pump during each of the breaks, wherein the pump-off sequence includes:

a first pump-off phase wherein the control facility is programmed to continuously operate the drain pump to remove substantially all of the wash fluid from the dishwasher;

a first break, following the first pump-off phase, wherein the control facility is programmed to continuously deactivate the drain pump;

a second pump-off phase, following the first break, wherein the control facility is programmed to continuously operate the drain pump to pump off a first partial quantity of the residual quantity of wash fluid remaining in the dishwasher at the completion of the first pump-off phase;

a second break, following the second pump-off phase, wherein the control facility is programmed to continuously deactivate the drain pump; and a third pump-off phase, following the second break, wherein the control facility is programmed to continuously operate the drain pump to pump off a second partial quantity of the residual quantity of wash fluid remaining in the dishwasher at the completion of the second pump-off phase, wherein the control facility is programmed to execute a short pump-off sequence, which comprises fewer pump-off phases than the pump-off sequence, at the end of a sub-cycle of the wash cycle provided as a final rinse cycle of the wash cycle.

30. A dishwasher, comprising:

a control facility programmed to control a wash cycle to clean items to be washed based on a plurality of selectable wash programs; and a drain pump operably connected to the control facility for pumping off wash fluid from the dishwasher, wherein the control facility is programmed to automatically execute, in at least one of the wash programs, a pump-off sequence configured to reduce a residual quantity of wash fluid remaining in the dishwasher at a completion of the pumping off the wash fluid from the dishwasher, the pump-off sequence having at least three successively executed pump-off phases during each of which the control facility is programmed to activate the drain pump, with a break being provided between each of the at least three successively executed pump-off phases, wherein the control facility is programmed to deactivate the drain pump during each of the breaks, wherein the pump-off sequence includes:

a first pump-off phase wherein the control facility is programmed to continuously operate the drain pump to remove substantially all of the wash fluid from the dishwasher;

a first break, following the first pump-off phase, wherein the control facility is programmed to continuously deactivate the drain pump;

a second pump-off phase, following the first break, wherein the control facility is programmed to continuously operate the drain pump to pump off a first partial quantity of the residual quantity of wash fluid remaining in the dishwasher at the completion of the first pump-off phase;

a second break, following the second pump-off phase, wherein the control facility is programmed to continuously deactivate the drain pump; and a third pump-off phase, following the second break, wherein the control facility is programmed to continuously operate the drain pump to pump off a second partial quantity of the residual quantity of wash fluid remaining in the dishwasher at the completion of the second pump-off phase, wherein the wash cycle comprises a plurality of sub-cycles, the plurality of sub-cycles including a prewash cycle, a cleaning cycle, an intermediate rinse cycle, a final rinse cycle, and a drying cycle, wherein the control facility is programmed to execute a first short pump-off sequence, which comprises fewer pump-off phases than the pump-off sequence, at the end of the prewash cycle, wherein the control facility is programmed to execute the pump-off sequence at an end of the intermediate rinse cycle, wherein the control facility is programmed to execute the pump-off sequence again at an end of the cleaning cycle, and wherein the control facility is programmed to execute a second short pump-off sequence, which comprises fewer pump-off phases than the pump-off sequence, at an end of the final rinse cycle.

31. A method for operating a dishwasher, the dishwasher comprising a control facility programmed to control a wash cycle to clean items to be washed based on a plurality of selectable wash programs; and a drain pump operably connected to the control facility for pumping off wash fluid from the dishwasher, wherein the control facility is programmed to automatically execute, in at least one of the wash programs, a pump-off sequence having at least three successively executed pump-off phases to define first, second and third pump-off phases, during each of which the control facility is programmed to activate the drain pump, with a break being provided between the first and second pump-off phases and a break being provided between the second and third pump-off phases, wherein the control facility is programmed to deactivate the drain pump during each of the breaks, the method comprising:

controlling wash cycles based on the plurality of selectable wash programs; and operating the drain pump for pumping off the wash fluid from the dishwasher in response to a selected one of the wash programs, wherein at least one of the wash programs automatically executes the pump-off sequence having the at least three successively executed pump-off phases to define the first, second and third pump-off phases, during each of which the drain pump is activated, with the break being provided between the first and second pump-off phases and the break being provided between the second and third pump-off phases, wherein the drain pump is deactivated during the duration each of the breaks, wherein the pump-off sequence includes:

continuously operating the drain pump, during a first pump-off phase, to remove substantially all of the wash fluid from the dishwasher;

continuously deactivating the drain pump, during a first break following the first pump-off phase, to thereby reduce turbulence in the residual quantity of wash fluid remaining in the drain pump;

continuously operating the drain pump, during a second pump-off phase following the first break, to pump off a first partial quantity of the residual quantity of wash fluid remaining in the dishwasher at the completion of the first pump-off phase;

continuously deactivating the drain pump, during a second break following the second pump-off phase, to thereby reduce turbulence in a remaining amount of the residual quantity of wash fluid remaining in the dishwasher at the completion of the second pump-off phase;

continuously operating the drain pump, during a third pump-off phase following the second break, to pump off a second partial quantity of the residual quantity of wash fluid remaining in the dishwasher at the completion of the second pump-off phase, wherein the wash cycle comprises a plurality of sub-cycles, and wherein the pump-off sequence is selectively executed only at ends of selective sub-cycles of the plurality of sub-cycles such that the pump-off sequence is not executed in all of the plurality of sub-cycles.

32. The method of claim 31 for operating a household dishwasher.

33. The method of claim 31, further comprising monitoring a wash fluid stream conveyed by the drain pump by a monitoring facility, and terminating the first pump-off phase when the monitoring facility identifies a drop below a minimum value for the wash fluid stream.

34. The method of claim 33, wherein the monitoring facility monitors at least one electrical operating parameter of an electric motor of the drain pump.

35. The method of claim 33, further comprising terminating the first pump-off phase when the monitoring facility detects the absence of a drop below the minimum value for the wash fluid stream after elapse of a predefined time period.

36. The method of claim 31, wherein at least one of the second and third pump-off phases and/or at least one of the breaks is terminated in a time-controlled manner.

37. The method of claim 31, wherein at least one of the breaks has a duration of at least 1 second.

38. The method of claim 31, wherein at least one of the breaks has a duration of at least 2 seconds.

39. The method of claim 31, wherein at least one of the breaks has a duration of at least 4 seconds.

40. The method of claim 31, wherein at least one of the breaks has a duration of a maximum of 24 seconds.

41. The method of claim 31, wherein at least one of the breaks has a duration of a maximum of 12 seconds.

42. The method of claim 31, wherein at least one of the breaks has a duration of a maximum of 7 seconds.

43. The method of claim 31, wherein at least one of the second and third pump-off phases has a duration of at least 1 second.

44. The method of claim 31, wherein at least one of the second and third pump-off phases has a duration of at least 2 seconds.

45. The method of claim 31, wherein at least one of the second and third pump-off phases has a duration of at least 4 seconds.

46. The method of claim 31, wherein at least one of the second and third pump-off phases has a duration of a maximum of 32 seconds.

47. The method of claim 31, wherein at least one of the second and third pump-off phases has a duration of a maximum of 16 seconds.

48. The method of claim 31, wherein at least one of the second and third pump-off phases has a duration of a maximum of 8 seconds.

49. The method of claim 31, wherein at least one further wash program selected from the plurality of wash programs is configured to perform a wash cycle and to provide the pump-off sequence at an end of a wash sub-cycle provided as an intermediate rinse cycle.

50. The method of claim 31, wherein at least one further wash program selected from the plurality of wash programs is configured to perform a wash cycle and to provide the pump-off sequence at an end of a wash sub-cycle provided as a cleaning cycle.

51. The method of claim 31, wherein at least one further wash program selected from the plurality of wash programs is configured to perform a wash cycle and to provide short pump-off sequence, which comprises fewer pump-off phases than the pump-off sequence, at the end of a wash sub-cycle provided as a prewash cycle.

52. The method of claim 31, wherein at least one further wash program selected from the plurality of wash programs is configured to perform a wash cycle and to provide a short pump-off sequence, which comprises fewer pump-off phases than the pump-off sequence, at the end of a wash sub-cycle provided as a final rinse cycle.

53. The method of claim 31, further comprising applying wash fluid to items to be washed by a circulating pump and deactivating the circulating pump during an entire duration of the pump-off sequence.

* * * * *